US010161295B2

(12) United States Patent
Wilder et al.

(10) Patent No.: US 10,161,295 B2
(45) Date of Patent: Dec. 25, 2018

(54) VEHICLE UNDER HOOD COOLING SYSTEM

(71) Applicants: James M Wilder, Farmington Hills, MI (US); Jeremy J Anker, Lake Orion, MI (US); Paul Rodriguez, White Lake, MI (US); Mark V Musial, Leonard, MI (US); Farhan Ehsan, Windsor (CA)

(72) Inventors: James M Wilder, Farmington Hills, MI (US); Jeremy J Anker, Lake Orion, MI (US); Paul Rodriguez, White Lake, MI (US); Mark V Musial, Leonard, MI (US); Farhan Ehsan, Windsor (CA)

(73) Assignee: FCA US LLC, Auburn Hills, MI (US)

( * ) Notice: Subject to any disclaimer, the term of this patent is extended or adjusted under 35 U.S.C. 154(b) by 481 days.

(21) Appl. No.: 15/088,175

(22) Filed: Apr. 1, 2016

(65) Prior Publication Data

US 2017/0284276 A1 Oct. 5, 2017

(51) Int. Cl.

| | |
|---|---|
| ***F01P 7/14*** | (2006.01) |
| ***F01P 7/16*** | (2006.01) |
| *F01P 1/00* | (2006.01) |

(52) U.S. Cl.

CPC ..... *F01P 7/167* (2013.01); *F01P 2001/005* (2013.01); *F01P 2031/30* (2013.01); *F01P 2060/02* (2013.01)

(58) Field of Classification Search

CPC ..... F01P 7/14; F01P 7/167; F01P 3/00; F01P 3/12; F01P 2031/005; F01P 2031/30; F01P 2060/02

See application file for complete search history.

(56) References Cited

U.S. PATENT DOCUMENTS

| | | | | |
|---|---|---|---|---|
| 4,381,736 | A | 5/1983 | Hirayama | |
| 5,521,581 | A * | 5/1996 | Proulx | F01P 11/14 123/41.14 |
| 6,758,172 | B2 | 7/2004 | Morgan et al. | |
| 2003/0116103 | A1 | 6/2003 | Murakami et al. | |
| 2004/0103862 | A1 | 6/2004 | Aidnik | |
| 2010/0155036 | A1 | 6/2010 | Andris et al. | |
| 2018/0135503 | A1 * | 5/2018 | Ernst | F01K 23/065 |

* cited by examiner

*Primary Examiner* — Grant Moubry
(74) *Attorney, Agent, or Firm* — Ralph E. Smith

(57) ABSTRACT

An engine cooling system includes an engine, an intercooler, a radiator fan, a cooling circuit thermally coupled to at least one of the engine and the intercooler and circulating a coolant, and a controller in signal communication with the cooling circuit. The controller is configured to: upon receipt of a request, when the engine is in an off state, activate a quick cooldown mode where the radiator fan and the cooling circuit are operated to circulate and supply the coolant to at least one of the engine and the intercooler to cool vehicle under hood components while the engine is in the off state.

15 Claims, 2 Drawing Sheets

VEHICLE UNDER HOOD COOLING SYSTEM

FIELD

The present application relates generally to a vehicle cooling system and, more particularly, to a vehicle under hood cooling system for selectively providing under hood cooling when the vehicle engine is off.

BACKGROUND

When a vehicle engine is shut off, conventional engine cooling systems no longer circulate coolant to cool the vehicle engine and, as a result, surrounding under hood components may "heat soak" thermal energy from the hot engine. This scenario can lower engine and component performance, thereby reducing vehicle performance, which is particularly undesirable in high performance situations such as track racing.

SUMMARY

In accordance with one example aspect of the invention, an engine cooling system for a vehicle is provided. The engine cooling system includes an engine, an intercooler, a radiator fan, a cooling circuit thermally coupled to at least one of the engine and the intercooler and circulating a coolant, and a controller in signal communication with the cooling circuit. The controller is configured to: upon receipt of a request, when the engine is in an off state, activate a quick cooldown mode where the radiator fan and the cooling circuit are operated to circulate and supply the coolant to at least one of the engine and the intercooler to cool vehicle under hood components while the engine is in the off state.

A method is provided for operating a cooling system for a vehicle having an engine, an intercooler, a radiator fan, and a cooling circuit thermally coupled to at least one of the engine and the intercooler and circulating a coolant. The method includes receiving a request to enable a quick cooldown mode, and activating the quick cooldown mode, when the engine is in an off state, such that the radiator fan and the cooling circuit are operated to circulate and supply the coolant to at least one of the engine and the intercooler to cool vehicle under hood components while the engine is in the off state.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings references therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DETAILED DESCRIPTION

Figure 1:
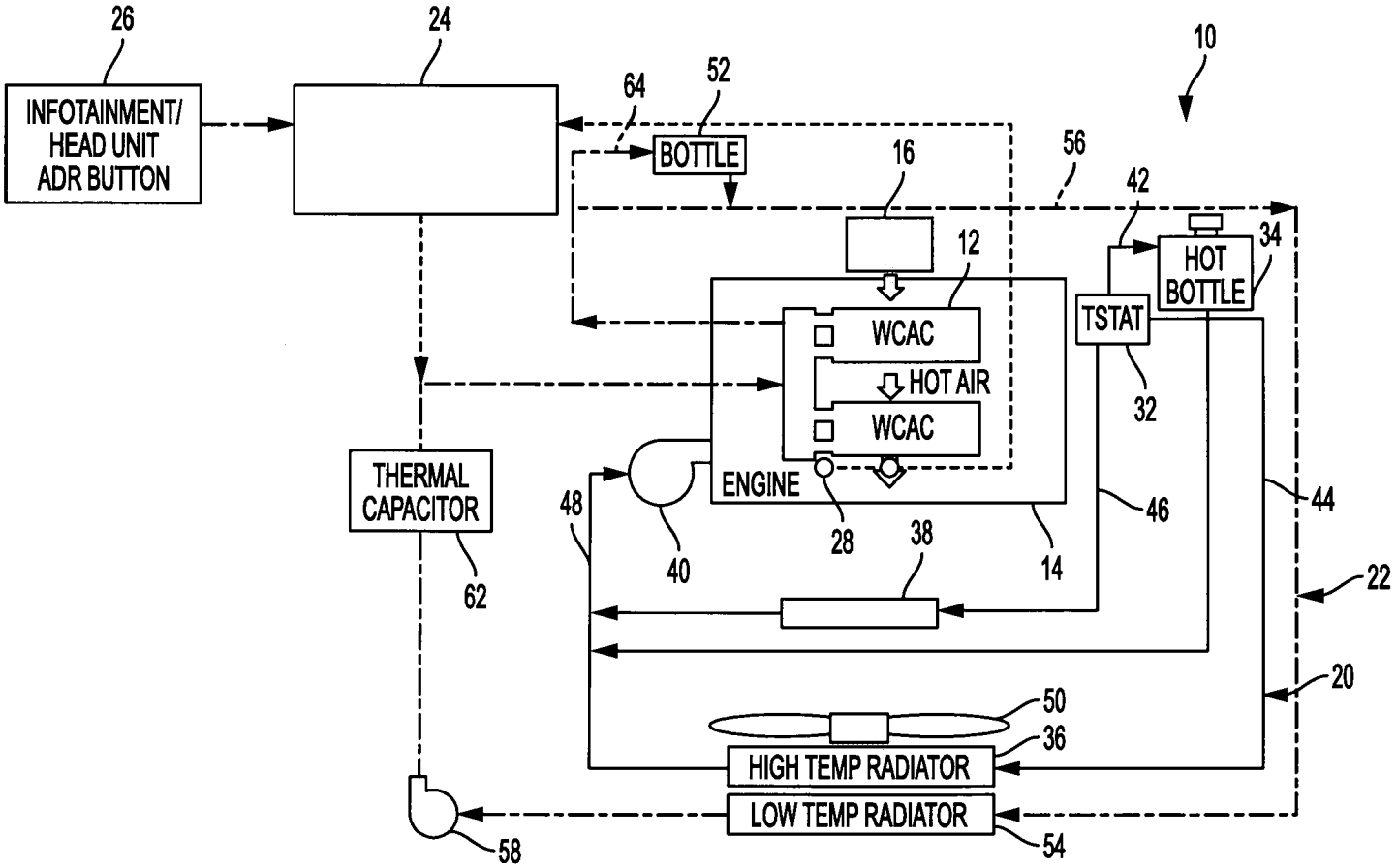
FIG. 1 is a schematic view of an example engine cooling system in accordance with the principles of the present disclosure.

With initial reference to FIG. 1, an example vehicle engine cooling system for a vehicle engine is illustrated and generally identified at reference numeral 10. The engine cooling system 10 is configured to provide cooling to an intercooler 12 and vehicle engine 14 that includes a turbocharger or supercharger 16. The intercooler 12 receives hot compressed air from the charger 16, absorbs heat therefrom, and subsequently supplies cooled, compressed air to an intake and cylinders (not shown) of the engine 14. In one exemplary implementation, the engine cooling system 10 generally includes a high temperature circuit 20 and a low temperature circuit 22.

The engine cooling system 10 is in signal communication with a controller 24 such as an engine control module (ECM), which is in signal communication with a vehicle user interface 26 and an engine coolant temperature sensor 28. As described herein in more detail, a user, such as a driver, may selectively initiate a "drag racing" or "track racing" driving mode for the vehicle, which includes a "quick cooldown" feature or sub-mode that operates when the engine 14 is off. This option provides increased cooling to intercooler 12 and/or engine 14, which results in increased engine power and performance.

As used herein, the term controller refers to an application specific integrated circuit (ASIC), an electronic circuit, a processor (shared, dedicated, or group) and memory that executes one or more software or firmware programs, a combinational logic circuit, and/or any other suitable components that provide the described functionality.

In one exemplary implementation, the high temperature circuit 20 circulates a first heat transfer fluid or coolant (e.g., water) and generally includes a thermostat 32, an overflow bottle 34, a high temperature radiator 36, a cabin heat exchanger 38, and a pump 40. The first coolant is heated by engine 14 and is subsequently supplied through thermostat 32 to a first branch conduit 42, a second branch conduit 44, and a third branch conduit 46.

The first branch conduit 42 directs heated coolant to the overflow bottle 34, which is configured to remove air trapped in the circuit 20. The coolant is then directed to a coolant supply line 48. The second branch conduit 44 directs heated coolant to the high temperature radiator 36, where the heated coolant is cooled by ambient air and/or an airflow created by a fan 50. The cooled coolant is then supplied to the coolant supply line 48. The third branch conduit 46 directs the heated coolant to the cabin heat exchanger 38 where thermal energy of the heated coolant is used to provide heating to the vehicle passenger cabin (not shown). The cooled coolant is then directed to the coolant supply line 48.

The pump 40 is disposed within circuit 20 and is configured to circulate the first coolant around the high temperature circuit 20. In the example embodiment, the first coolant may be selectively supplied to branch conduits 42, 44, 46 such that each of the branch conduits may be used alone or in any combination. As such, pump 40 supplies the cooled coolant within supply line 48 to the engine 14 to provide cooling thereto.

In one exemplary implementation, the low temperature circuit 22 is fluidly separate from high temperature circuit 20 and circulates a second heat transfer fluid or coolant such as water. In the illustrated example, the low temperature circuit 22 is dedicated to providing cooling to the intercooler 12. Low temperature circuit 22 generally includes an overflow bottle 52, a low temperature radiator 54, and a pump 58. In some implementations, as illustrated, circuit 22 may also include a thermal capacitor 62. The second coolant is heated within intercooler 12 against the hot compressed air from charger 16, and is directed to low temperature radiator 54 via a conduit 56. Along the way, at least a portion of the heated coolant may be directed along a loop 64 to the overflow bottle 52, which is configured to remove air trapped in circuit 22.

The heated second coolant is cooled within the low temperature radiator 54 by ambient air and/or airflow from fan 50. The cooled coolant is subsequently supplied to intercooler 12 via pump 58, which is disposed within circuit 22 and is configured to circulate the second coolant around the low temperature circuit 22. The cooled coolant subsequently cools the charge air passing through intercooler 12. When utilized in circuit 22, thermal capacitor 62 is used as a low temperature reservoir configured to store pre-cooled coolant to provide increased cooling to intercooler 12, act as a buffer for transient thermal inertia, and avoid AC compressor shock. In the illustrated example, the low temperature radiator 54 and the high temperature radiator 36 are discrete components.

As described herein, the engine cooling system 10 includes a "quick cooldown mode" that may be requested or selected for operation when the vehicle engine 14 is off and the driver prioritizes lower under hood temperatures over noise, vibration, and battery charge. When the mode is activated, the high temperature circuit 20 and/or the low temperature circuit 22 are operated (i.e., coolant circulated therein) to reduce the temperature of the coolant fluids (in circuits 20, 22) and under hood components such as radiators 36, 54, charge coolers 12, intake manifold, the block and cylinder heads of engine 14, thermal capacitor 62, and charger 16. Thus, system 10 is especially useful for track applications and allows a driver to achieve comparatively improved engine operating performance under race conditions, by lowering temperatures or minimizing heating soaking between runs.

In operation, the engine cooling system 10 by default is shut off when the vehicle engine 14 is shut off. However, when the driver desires increased engine performance, for example when the engine is hot and prior to a subsequent race, the driver can manually select the quick cooldown mode. For example, the driver may select a quick cooldown mode icon or button on the user interface 26, provide a voice command to the vehicle, or select a switch/button on the instrument panel, steering wheel, etc.

The quick cooldown mode may be requested while the vehicle engine 14 is on, but the quick cooldown mode will only operate if the engine 14 is off and further system conditions are satisfied. For example, once controller 24 receives a signal that the driver has requested the quick cooldown mode, the controller 24 determines if one or more of the following system conditions are satisfied: (i) the engine is off; (ii) a vehicle hood (not shown) is closed; (iii) a vehicle battery (not shown) has an acceptable status (e.g., voltage and state of charge are above predetermined threshold values); (iv) no fault codes present that are related to the feature operation (e.g., any faults from pump 58 such as communications, coolant level, temperature, current draw, etc., and any faults from fan 50 such as communications, wiring, current draw, etc.); (v) under hood cooling is required (as determined by a temperature difference Δtemp, between the ambient temperature and a temperature of the low temperature coolant, being above a predetermined threshold); and (vi) a quick cooldown mode duration timer has not exceeded a predetermined time limit. However, it should be noted that engine cooling system 10 may include additional system conditions that must be satisfied for the operation of the quick cooldown mode.

If the engine is off and the other system conditions are satisfied, controller 24 activates the quick cooldown mode and operates radiator fan 50 and coolant pumps 40 and/or 58. As such, the coolants in high temperature and/or low temperature circuits 20, 22 continue to be cooled by radiator fan 50 and continue to circulate, thereby providing continued cooling to intercooler 12, thermal capacitor 62, and engine 14, even though the engine 14 is off.

The quick cooldown mode can be deactivated upon the occurrence of certain conditions. For example, the quick cooldown mode may be canceled manually by the driver (e.g., through user interface 26), or the engine cooling system 10 may automatically disable the feature if one or more predetermined exit conditions are satisfied. As such, the quick cooldown mode will remain active and automatically cool the underhood components after each race until the mode is manually canceled or automatically disabled, thereby obviating the need for the driver to initiate the quick cooldown mode after every restart of the vehicle.

Example exit conditions may include, but are not limited to, (a) the low and/or high temperature coolant reaches a predetermined target temperature; (b) a deactivation timer exceeds a predetermined time limit; (c) the vehicle battery has an unacceptable status (e.g., voltage and state of charge fall below predetermined threshold values); and/or (d) non-racing vehicle operation is detected (e.g., vehicle speed is above a predetermined threshold for a predetermined period of time or for a predetermined distance, such as over 35 mph for more than a mile). However, it should be noted that engine cooling system 10 may include additional exit conditions cause system 10 to automatically deactivate the quick cooldown mode.

Figure 2:
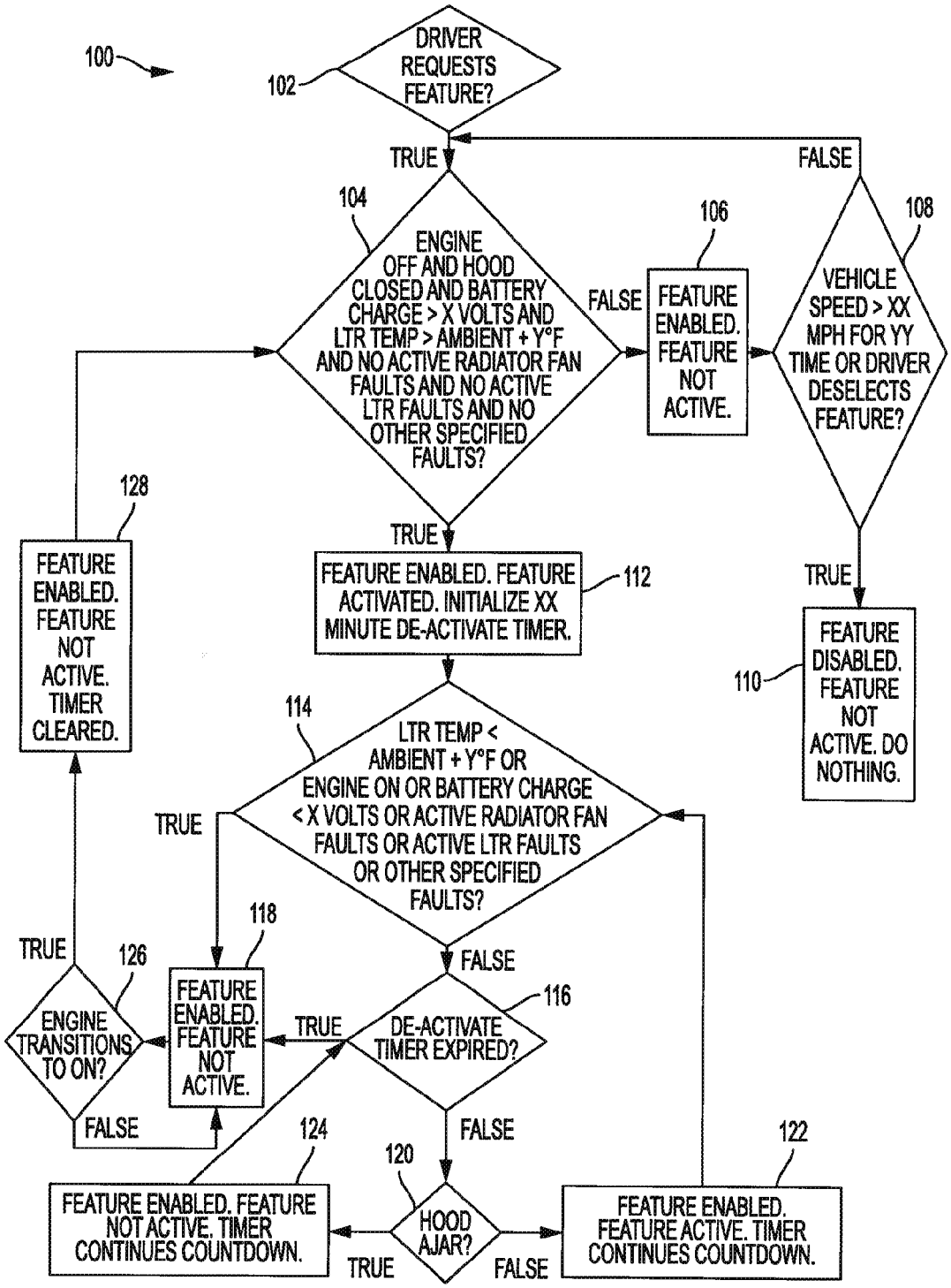
FIG. 2 is a schematic flow diagram of an example operation of the engine cooling system shown in FIG. 1.

FIG. 2 illustrates an example method 100 of operating engine cooling system 10. At step 102, vehicle controller 24 receives a signal indicating that the driver has requested the quick cool down mode (e.g., via the user interface 26). At step 104, controller 24 confirms one or more system conditions are satisfied before proceeding to activate the mode. In one example implementation, the system conditions include one or more of the following: (i) the engine is off; (ii) the hood is closed; (iii) the vehicle battery has an acceptable status; (iv) no fault codes present that are related to the feature operation; (v) under hood cooling is required; and (vi) the quick cooldown mode duration timer has not exceeded a predetermined time limit. However, step 104 is not limited to the above described conditions and may include additional system conditions.

If one or more of the system conditions are not satisfied, at step 106, controller 24 designates the quick cooldown mode as enabled, but does not activate the quick cooldown mode. At step 108, controller 24 subsequently determines if one or more exit conditions occur. In one example implementation, the exit conditions include one or more of the following: (a) the driver manually deselects the quick cooldown mode feature; and (b) a non-racing vehicle operation is detected. However, step 108 is not limited to the above described conditions and may include additional exit conditions. If one of the exit conditions occurs, at step 110, controller 24 disables the quick cooldown mode. If no exit condition(s) occur, control returns to step 104.

If the one or more system conditions are satisfied at step 104, control proceeds to step 112 where controller 24 activates the quick cooldown mode by activating coolant pump 40, coolant pump 58, and/or radiator fan 50. In addition, controller 24 starts a quick cooldown mode deactivation timer.

At step 114, controller 24 determines if one or more exit conditions occur during operation of the quick cooldown mode. In one example implementation, the exit conditions include one or more of the following: (a) the low and/or high temperature coolant reaches a predetermined target temperature; (b) the vehicle battery has an unacceptable status (e.g., voltage and state of charge fall below predetermined threshold values); (c) a fault is present related to the feature operation (e.g., radiator fan, coolant circuits); (d) other predetermined faults are present. However, step 114 is not limited to the above described conditions and may include additional exit conditions.

If no exit conditions are detected at step 114, controller 24 determines if the deactivation timer has exceeded the predetermined time limit at step 116. If the predetermined time limit is exceeded, control proceeds to step 118. If the predetermined time limit is not exceeded, control proceeds to step 120 where controller 24 determines if the vehicle hood is ajar. If the hood is not ajar, at step 122, controller 24 continues the quick cooldown mode and deactivation timer countdown. Control then returns to step 114. If the hood is ajar, at step 124, controller 24 deactivates the quick cooldown mode and continues the deactivation timer countdown. Control then returns to step 116.

If exit conditions are detected at step 114, or the predetermined time limit is exceeded at step 116, control proceeds to step 118 where controller 24 deactivates the quick cooldown mode. At step 126, controller 24 subsequently determines if the engine has been started. If the engine has not started, control returns to step 118. If the engine has started, controller 24 resets the deactivation timer countdown at step 128 and subsequently returns to step 104.

Described herein are system and methods for providing under hood cooling to a vehicle once the engine is off. A driver control system is in communication with a network controller, which is configured to control an engine cooling system. Upon satisfying system conditions, the controller activates a quick cooldown mode where a radiator fan and high and low temperature cooling circuits are operated while the vehicle engine is off, thereby providing cooling to the engine and underhood components and improving engine performance. The quick cooling mode is deactivated either manually by the driver or automatically by the vehicle/system when exit conditions have been satisfied. The vehicle then returns to normal operating behavior after the quick cooldown mode is deactivated. Accordingly, the quick cooldown mode allows a driver to achieve comparatively improved engine operating performance, for example, under race conditions where lowering temperatures and minimizing heat soaking between runs is important.

It should be understood that the mixing and matching of features, elements and/or functions between various examples may be expressly contemplated herein so that one skilled in the art would appreciate from the present teachings that features, elements and/or functions of one example may be incorporated into another example as appropriate, unless described otherwise above.

What is claimed is:

1. An engine cooling system for a vehicle, the system comprising:

an engine;

an intercooler;

a radiator fan;

a cooling circuit thermally coupled to at least one of the engine and the intercooler and circulating a coolant; and a controller in signal communication with the cooling circuit, the controller configured to:

upon receipt of a request, when the engine is in an off state, activate a quick cooldown mode where the radiator fan and the cooling circuit are operated to circulate and supply the coolant to at least one of the engine and the intercooler to cool vehicle under hood components while the engine is in the off state.

2. The system of claim 1, wherein the cooling circuit is a high temperature cooling circuit circulating a first coolant, and further comprising a low temperature cooling circuit thermally coupled to at least one of the engine and the intercooler and circulating a second coolant, wherein the controller is in signal communication with both the high temperature cooling circuit and the low temperature cooling circuit, the controller configured to:

upon receipt of the request, when the engine is in the off state, activate the quick cooldown mode where the radiator fan, the high temperature cooling circuit, and the low temperature cooling circuit are operated to circulate and supply the first and second coolants to at least one of the engine and the intercooler to cool the vehicle under hood components while the engine is in the off state.

3. The system of claim 1, wherein the controller is configured to determine whether a system condition is satisfied before activating the quick cooldown mode, the system condition including at least one of:

(i) the engine is off;

(ii) a hood of the vehicle is closed;

(iii) a battery of the vehicle has an acceptable status where a voltage and/or a state of charge are above predetermined threshold values;

(iv) no system fault codes are present;

(v) under hood cooling is required; and (vi) a quick cooldown mode duration timer has not exceeded a predetermined time limit.

4. The system of claim 3, wherein the controller is configured to prevent activation of the quick cooldown mode if an exit condition occurs, the exit condition including at least one of:

(a) receiving a signal indicating a driver manually deselects the quick cooldown mode; and (b) a non-racing vehicle operation is detected.

5. The system of claim 4, wherein the non-racing vehicle operation comprises traveling above a predetermined vehicle speed for a predetermined distance.

6. The system of claim 3, wherein the controller is configured to deactivate the quick cooldown mode if an exit condition occurs during the quick cooldown mode, the exit condition including at least one of: (a) the coolant reaches a predetermined target temperature; (b) the vehicle battery has an unacceptable status where the voltage and/or state of charge are above the predetermined threshold values; (c) a vehicle fault is present; and (d) the duration timer has exceeded the predetermined time limit.

7. The system of claim 1, wherein the controller is configured to determine whether a plurality of system conditions are satisfied before initiating the quick cooldown mode, wherein the plurality of system conditions includes:

(i) the engine is off;

(ii) a hood of the vehicle is closed;

(iii) a battery of the vehicle has an acceptable status where a voltage and/or a state of charge are above predetermined threshold values;

(iv) no system fault codes are present;

(v) under hood cooling is required; and (vi) a quick cooldown mode duration timer has not exceeded a predetermined time limit.

8. The system of claim 7, wherein the controller is configured to initiate the quick cooldown mode only if all of the plurality of system conditions are satisfied.

9. The system of claim 7, wherein under hood cooling is required when a temperature differential between the ambient temperature and a temperature of the coolant is above a predetermined threshold.

10. The system of claim 7, wherein the controller is configured to prevent activation of the quick cooldown mode at least one first exit condition occurs, the first exit conditions including:

(a) receiving a signal indicating a driver manually deselects the quick cooldown mode; and (b) a non-racing vehicle operation is detected; and wherein the controller is further configured to deactivate the quick cooldown mode if at least one second exit condition occurs during the quick cooldown mode, the second exit conditions including:

(a) the coolant reaches a predetermined target temperature;

(b) the vehicle battery has an unacceptable status where the voltage and/or state of charge are above the predetermined threshold values;

(c) a vehicle fault is present; and (d) the duration timer has exceeded the predetermined time limit.

11. A method of operating a cooling system for a vehicle having an engine, an intercooler, a radiator fan, and a cooling circuit thermally coupled to at least one of the engine and the intercooler and circulating a coolant, the method comprising:

receiving a request to enable a quick cooldown mode; and activating the quick cooldown mode, when the engine is in an off state, such that the radiator fan and the cooling circuit are operated to circulate and supply the coolant to at least one of the engine and the intercooler to cool vehicle under hood components while the engine is in the off state.

12. The method of claim 11, wherein the cooling circuit is a high temperature cooling circuit circulating a first coolant, and the vehicle further including a low temperature cooling circuit thermally coupled to at least one of the engine and the intercooler and circulating a second coolant, and wherein the step of initiating the quick cool down mode comprises:

activating the quick cooldown mode, when the engine is in an off state, such that the radiator fan, the high temperature cooling circuit, and the low temperature cooling circuit are operated to circulate and supply the first and second coolants to at least one of the engine and the intercooler to cool the vehicle under hood components while the engine is in the off state.

13. The method of claim 12, further comprising determining if each system condition of a set of system conditions is satisfied before activating the quick cooldown mode, the set of system conditions including:

(i) the engine is off;

(ii) a hood of the vehicle is closed;

(iii) a battery of the vehicle has an acceptable status where a voltage and/or a state of charge are above predetermined threshold values;

(iv) no system fault codes are present;

(v) under hood cooling is required; and (vi) a quick cooldown mode duration timer has not exceeded a predetermined time limit.

14. The method of claim 13, further comprising:

determining if one first exit condition of a set of first exit conditions occurs, the set of first exit conditions including:

(a) receiving a signal indicating a driver manually deselects the quick cooldown mode; and (b) a non-racing vehicle operation is detected; and preventing activation of the quick cooldown mode if one first exit condition occurs.

15. The method of claim 14, further comprising:

determining if one second exit condition of a set of second exit conditions occurs during the quick cooldown mode, the set of second exit conditions including:

(a) the heat transfer fluid reaches a predetermined target temperature;

(b) the vehicle battery has an unacceptable status where the voltage and/or state of charge are above the predetermined threshold values;

(c) a vehicle fault is present; and (d) the duration timer has exceeded the predetermined time limit; and deactivating the quick cooldown mode if one second exit condition occurs during the quick cooldown mode.

* * * * *